US005173366A

United States Patent [19]

Mitamura et al.

[11] Patent Number: 5,173,366

[45] Date of Patent: Dec. 22, 1992

[54] ELECTRICALLY CONDUCTIVE FIBERS, APPARATUS AND METHOD FOR THE PRODUCTION THEREOF

[75] Inventors: Hideyuki Mitamura; Fumikazu Yoshida, both of Ootsu; Tatsuo Shimura, Takashima, all of Japan

[73] Assignee: Toyo Boseki Kabushiki Kaisha, Osaka, Japan

[21] Appl. No.: 789,539

[22] Filed: Nov. 8, 1991

Related U.S. Application Data

[63] Continuation of Ser. No. 420,390, Oct. 12, 1989, abandoned.

[30] Foreign Application Priority Data

| | | | |
|---|---|---|---|
| Oct. 20, 1988 | [JP] | Japan | 63-264714 |
| Oct. 25, 1988 | [JP] | Japan | 63-270136 |
| Mar. 3, 1989 | [JP] | Japan | 1-52320 |

[51] Int. Cl.[5] ..... B23B 27/00

[52] U.S. Cl. ..... 428/373; 428/374

[58] Field of Search ..... 428/373, 374

[56] References Cited

U.S. PATENT DOCUMENTS

| | | | |
|---|---|---|---|
| 3,001,265 | 9/1961 | Bundy | 428/373 |
| 3,003,223 | 10/1961 | Breen | 428/373 |

*Primary Examiner*—Patrick J. Ryan
*Assistant Examiner*—Richard C. Weisberger
*Attorney, Agent, or Firm*—Wegner, Cantor, Mueller & Player

[57] ABSTRACT

Electrically conductive conjugate fibers having a diameter less than 50μm. The fibers include a thermoplastic sheath and a low-melting metal core, with the core occupying 0.2 to 50% of the sectional area of the fiber. The sectional area of the core varies by less than 25% in the longitudinal direction, and the total length of the discontinuous portions of the core is 5 cm or less per meter. The fibers can be produced with a conjugate spinning nozzle. The low-melting metal is provided to the nozzle from the closed fusion tank located at a position below the spinning nozzle. The metal is supplied to the spinning nozzle by means of pressure from inert gas, which is supplied to an upper space of the fusion tank. The level of metal in the fusion tank is maintained substantially constant, and the pressure of the gas is controlled so as to maintain a pressure variation of 0.1 kg/cm$^2$ or less.

6 Claims, 2 Drawing Sheets

Fig. 1
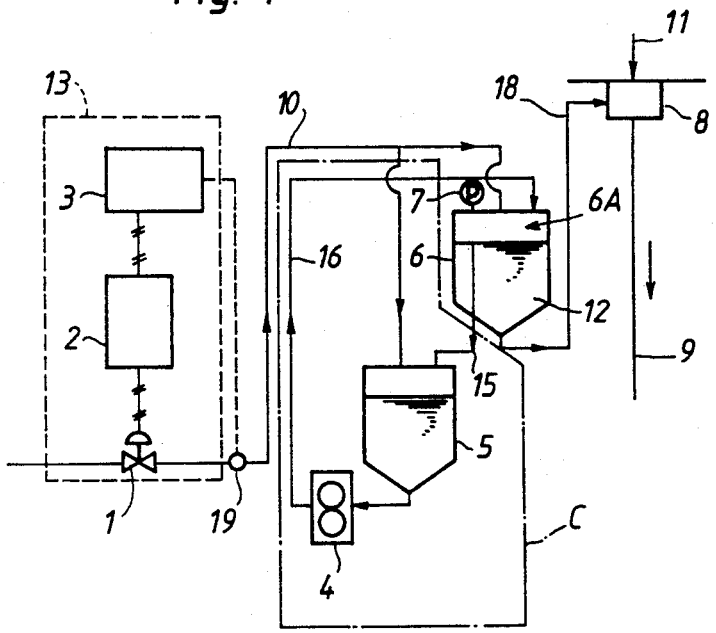
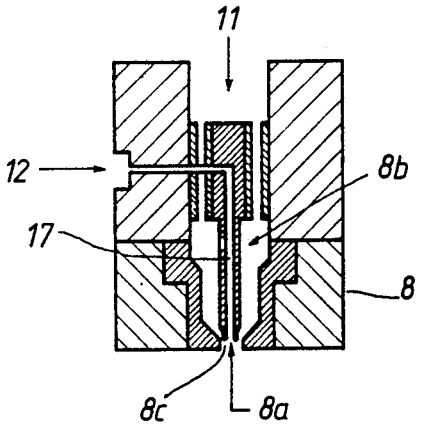
Fig. 2
Fig. 3
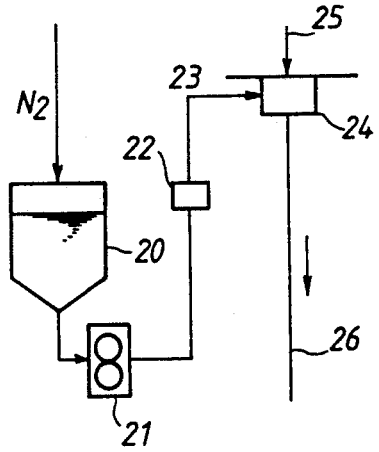

ELECTRICALLY CONDUCTIVE FIBERS, APPARATUS AND METHOD FOR THE PRODUCTION THEREOF

This application is a continuation of U.S. application Ser. No. 07/420,390 filed Oct. 12, 1989, now abandoned.

The present invention relates to electrically conductive fibers, particularly electrically conductive conjugate fibers containing a low melting temperature metal (hereinafter referred to as low-melting metal) as an electrically conductive substance, and an apparatus and a method for producing said fibers.

BACKGROUND OF THE INVENTION

Synthetic fibers such as for example polyesters fibers, polyamide fibers, etc., because of their low electric conductivity, are easy to generate static electricity by friction. Consequently, in using fabrics comprising such synthetic fibers, various obstacles accompanying attachment of dusts, electric discharge, etc. are generated. In order to solve these problems, incorporating electrically conductive fibers in textile goods is known. For example, metal fibers, metallized fibers, fibers mixed with carbon black and/or an electrically conductive substance, etc. have been proposed as the electrically conductive fibers [Japanese Patent Publication Nos. 44,579/1978 and 37,322/1981, Japanese Patent Kokai (Laid-open) No. 193,520/1982].

These electrically conductive fibers, however, have not been satisfactory because they have various problems in one or more yarn properties, production of mixed knitted goods and mixed woven goods with other fibers, and the hue and dyeability of these goods.

Further, conjugate fibers comprising an alloy as the core and a thermoplastic polymer as the sheath are known as fiber, having excellent electric conductivity and dyeability [Japanese Patent Kokai (Laid-open) No. 11,909/1976]. However, for reasons that the alloy, a core, has a low viscosity and a high surface tension, and besides that such an apparatus as shown in FIG. 5 is used to produce the conjugate fibers, it is very difficult to supply the fused alloy at a constant rate. It is therefore difficult to make the diameter of the core definite, and thin portions and thick portions appear irregularly. As a result, the fused alloy is broken, in many cases, at the thin portions at the time of drawing, which makes not only the diameter of the core alloy variable, but also the length of the core alloy and the hollow nonuniform. Because of this, not only the appearance is much damaged, but also satisfactory electric conductivity and yarn properties are difficult to obtain, and so such conjugate fibers have not been goods which can be placed on the market.

Particularly, when thin conjugate fibers (diameter, generally 50 μm or less) used in clothing, etc. are produced, it is very difficult to supply a fused metal continuously and in a definite amount. For all the devices, conjugate fibers having satisfactory qualities as well as an apparatus and a method for producing them are not yet developed.

SUMMARY OF THE INVENTION

In view of such the situation, the present inventors have extensively studied to establish an apparatus and a method which make it possible to supply a fused metal to a conjugate spinning nozzle stably, continuously and in a definite amount, whereby sheath-core type conjugate fibers having a uniform core can be produced.

As a result, firstly, the fiber of the present invention which can solve the foregoing problems is an electrically conductive conjugate fiber comprising a thermoplastic polymer as the sheath and a low-melting metal as the core, characterized in that the sectional area of the core occupies 0.2 to 50% of that of the fiber, the percent variation of the sectional area of the core in the longitudinal direction is 25% or less and the total length of the discontinuous portions of the core in the longitudinal direction is 5 cm or less per meter of the core.

Second, the manufacturing apparatus of the present invention is an apparatus in which a closed fusion tank is provided at a position below a conjugate spinning nozzle, said tank and nozzle are connected through a fused metal supply tube, the upper space of said tank communicates with an inert gas supply tube for supplying an inert gas of a definite pressure to said tank, and there is provided a control mechanism for maintaining the liquid level within said tank constant, and are apparatus in which there are provided a conjugate spinning nozzle having a fused metal supply path filled with at least one packing, and a gear pump.

Thirdly, the manufacturing method of the present invention is a method in which a low-melting metal in a molten state is supplied from a fusion tank to a conjugate spinning nozzle and discharged therefrom by the pressure of an inert gas controlled so as to maintain a pressure variation of 0.1 kg/cm$^2$ or less while maintaining the level of the fused metal within said tank almost constant, whereby the core is formed, and a method in which a low-melting metal in a molten state is supplied to a fused metal supply path within a conjugate spinning nozzle filled with at least one packing by means of a gear pump, whereby the core is formed.

The thermoplastic polymer constituting the sheath of the electrically conductive conjugate fibers of the present invention may be any of fiber-forming polymers which can be used for melt-spinning. A preferred polymer, however, is one having a melt viscosity of 3,000 to 8,000 poises at 300° C., particularly preferably 4,000 to 7,000 poises at 300° C. When the melt viscosity is less than 3,000 poises at 300° C., balance between the core and sheath becomes bad to cause the rupture of the sheath. Conjugate fibers having a uniform core are therefore difficult to obtain, which is not preferred. While when the melt viscosity exceeds 8,000 poises at 300° C., continuous and uniform running of the fused metal into the sheath becomes difficult, and the degree of discontinuity of the core increases. Excellent electric conductivity is therefore difficult to obtain, which is not preferred.

Specific examples of the polymer include polyesters (e.g. polyethylene terephthalate, polybutylene terephthalate), polyamides (e.g. nylon 6, nylon 66), polyolefins (e.g. polyethylene, polypropylene) and polymers consisting mainly of these polymers. In addition, there may be mentioned heat-resistant thermoplastic polymers such as polyphenylenesulfide, polyetheretherketone, polyethylene 2,6-naphthalate, wholly aromatic polyester, etc.

Further, in the thermoplastic polymer constituting the sheath may be incorporated, if necessary, any of additives such as dull agents, coloring agents, antioxidants, etc. Particularly, when the degree of whiteness and the dyeability of the electrically conductive conjugate fibers are taken into account, polyesters and nylons containing 1 to 2% of titanium dioxide are preferred as the thermoplastic polymer.

As the low-melting metal constituting the core of the electrically conductive conjugate fibers of the present invention, there are mentioned those having a melting point between about 50° C. and the melting point of the thermoplastic polymer. Specific examples of such the metal include metals [e.g. indium (In), selenium (Se), tin (Sn), bismuth (Bi), lead (Pb), cadmium (Cd)], etc. and binary, ternary and quaternary alloys comprising these metals. Specific examples of the alloys include Bi/Sn, Bi/In, Sn/Pb, Bi/Sn/In, Bi/Pb/Cd, Bi/Pb/Sn, Bi/Sn-/In/Pb, Bi/Sn/Pb/Cd, Bi/Sn/In/Pb/Cd, etc.

In the conjugate fibers of the present invention, the proportion of the sectional area of the core to that of the fibers, the percent variation of the sectional area of the core in the longitudinal direction, the continuity of the core in the same direction, etc, largely affect the electric conductivity, yarn properties, hue, dyeability, etc. of the conjugate fibers, so that said proportion is 0.2 to 50%. However, it is preferably 0.5 to 30% when the yarn properties, dyeability, etc. are taken into account. Since said percent variation affects the drawing property and yarn properties of the conjugate fibers, it needs to be 25% or less. Particularly preferably, it is 10% or less.

The continuity of the core in the longitudinal direction affects the electric conductivity, but if the total length of the discontinuous portions is 5 cm or less per meter of the core, there is no problem in terms of the electric conductivity. The total length, however, is preferably 1 cm or less. When the total length of the discontinuous portions exceeds 5 cm/meter specified in the present invention, not only the electric conductivity lowers, but also the yarns obtained have much unevenness as a property of yarn.

In order that the electric conductivity of goods in which electrically conductive yarns are used, may be within the standards described in "Recommended Standards of Construction of Appliances used for Protection against Electrostatic Hazards" made by Industrial Safety Research Institute of Ministry of Labor, Japan, and JIS T-8118, the electrically conductive yarns generally need to have a specific electric resistance (volume resistivity) of about $10^4$ Ω·cm.

The electrically conductive conjugate fibers of the present invention have not only a specific electric resistance satisfying the above standards, but also yarn properties not causing any problem i mixed knitted goods or mixed woven goods with other yarns. Besides, there are no problems in the dyeability.

The apparatus and method for producing the electrically conductive conjugate fibers of the present invention will be illustrated more specifically by referring to the accompanying drawings.

DESCRIPTION OF THE DRAWINGS

FIG. 1 is a schematic view illustrating one representative embodiment of the manufacturing apparatus of the present invention.

FIG. 2 is an enlarged sectional view of a conjugate spinning nozzle in FIG. 1.

FIG. 3 is a schematic view illustrating another embodiment of the manufacturing apparatus of the present invention.

Figure 4:
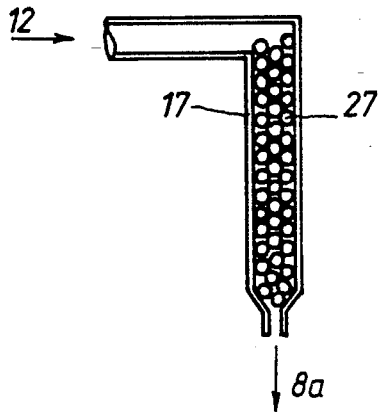
FIG. 4 is an enlarged sectional view of a fused metal supply path in FIG. 2.

In these drawings, the numerals designate the following members and apparatus:

| | | | |
|---|---|---|---|
| 1. | Pressure controlling valve | 2. | Power amplifier |
| 3. | Control circuit | 4. | Gear pump |
| 5. | Sub-tank | 6. | Fusion tank |
| 7. | Pressure gauge | 8. | Conjugate spinning nozzle |
| 9. | Conjugate fibers | 10. | Inert gas supply tube |
| 11. | Thermoplastic polymer | 12. | Fused metal |
| 13. | Pressure regulating apparatus | | |
| 14a, 14b. | Terminal | 15. | Overflow tube |
| 16. | Fused metal supply tube | 17. | Fused metal path |
| 18. | Fused metal supply tube | 19. | Pressure sensor |
| 20. | Fusion tank | 21. | Gear pump |
| 22. | Filter | 23. | Fused metal |
| 24. | Conjugate nozzle | 25. | Thermoplastic polymer |
| 26. | Conjugate fiber | 27. | Packing |

DETAILED DESCRIPTION

FIG. 1 is a view illustrating a representative embodiment of the present invention. There is no special reason to limit the structure itself of a conjugate spinning nozzle 8. Any structure freely designed will do, but generally such a structure as shown in FIG. 2 is popularly used. The conjugate spinning nozzle 8 is connected with a fusion tank 6 through a fused metal supply tube 18 as shown in FIG. 1. The level of a fused metal 12 in the fusion tank 6 is fixed so as to be below the tip of the conjugate spinning nozzle 8. That is, in supplying the fused metal 12 to the conjugate spinning nozzle 8, the natural law by which the fused metal spontaneously flows down to the nozzle 8 by the action of gravity is not used at all. As described later, the apparatus in FIG. 1 is constructed so that constant supply of the fused metal can easily be carried out by controlling the pressure of an inert gas.

In the present invention, a control mechanism C is provided in order to maintain the liquid level in the fusion tank 6 constant. The control mechanism C is composed of a sub-tank 5 for supply, an overflow tube 15 for connecting the sub-tank 5 to the fusion tank 6 and a fused metal supply tube 16. A gear pump 4 is mounted on the tube 16. The upper opening of the overflow tube 15 is fixed at a required level in the fusion tank 6, and the fused metal 12 over the level overflows the edge of the opening and flows down to the sub-tank 5 through the tube 15. Since the fused metal in the fusion tank 6 is supplied to the conjugate spinning nozzle 8, it decreases gradually. However, the fused metal is supplied, by an amount somewhat larger than that supplied to the nozzle 8, to the fusion tank 6 from the sub-tank 5 through the supply tube 16. The excess fused metal 12 is discharged through the overflow tube 15, whereby the level of the fused metal 12 in the fusion tank 6 is kept constant.

On the other hand, the upper space 6A of the fusion tank 6 communicates with an inert gas supply tube 10, and a pressure controlling apparatus 13 is provided at an optional position near the supply tube 10. The apparatus 13 is composed of a regulating valve 1 mounted on the tube 10, a control circuit 3 for regulating the degree of opening of the valve 1 and a power amplifier 2. A numeral 19, shows a pressure sensor. Further, the other end of the tube 10 is connected to a pressure generating source (not shown) such as blowers, pressure pumps, etc.

The control mechanism C described above is not limited to the example shown in FIG. 1, but may be those in which a float or level sensor is used. Further, the inert gas pressure controlling apparatus 13 may be those in which a tuffer tank or known pressure controlling means is provided.

An inert gas having a definite pressure controlled by the pressure controlling apparatus 13 applies pressure to the fusion tank 6 through the supply tube 10, thereby quantitatively supplying the fused metal 12 to the conjugate spinning nozzle 8. To the nozzle 8 is supplied a molten thermoplastic polymer 11 through an extruder (E in FIG. 5), and in this nozzle 8, the metal and polymer are combined to form a sheath-core structure. The nozzle 8, as mentioned above, has such structure as shown by its cross-section in FIG. 2. In the interior of this nozzle, the fused metal 12 is supplied to an inner nozzle 8*a* through a fused metal path 17, and the molten thermoplastic polymer 11 is supplied to an outer nozzle 8*c* through a chamber 8*b*. Consequently, on spinning the both at the same time from the nozzles, there are obtained sheath-core type conjugate fibers 9 comprising the metal as the core and the thermoplastic polymer as the sheath.

As the inert gas for supplying a definite amount of the fused metal to the conjugate spinning nozzle 8, nitrogen, argon, helium, etc. are used. The pressure of the gas depends upon the intrinsic viscosity of the thermoplastic polymer, dimension of the conjugate spinning nozzle, position of the fused metal tank, etc. From the practical point of view, however, the pressure is 0.05 to 10 kg/cm$^2$, more preferably 0.1 to 5 kg/cm$^2$. When the pressure is lower than 0.05 kg/cm$^2$, the power to push the fused metal in the fusion tank 6 downward is too weak to supply the metal to the conjugate spinning nozzle 8 continuously and stably. On the other hand, when the pressure exceeds 10 kg/cm$^2$, the amount of the fused metal supplied becomes too large to keep balance between the amount of the metal and that of the thermoplastic polymer. As a result, the polymer forming the sheath is cracked or broken.

The characteristics of the manufacturing method of the present invention consist in that, in supplying the low-melting metal in a molten state to the conjugate spinning nozzle 8 under pressure, pressure variation of the inert gas is limited to 0.1 kg/cm$^2$ or less while maintaining the liquid level in the fusion tank 6 constant which is provided at the upstream side of the nozzle 8. When the pressure variation is less than 0.1 kg/cm$^2$, variation of the sheath-core ratio (explained later) of the core becomes small, so that the physical properties of yarns as a product and the hue of the fibers become good. Further, when the yarn properties and the unevenness of knitted and woven goods are taken into account, it is more preferred to limit the pressure variation to 0.05 kg/cm$^2$ or less. On the other hand, when the pressure variation exceeds 0.1 kg/cm$^2$, the sheath-core ratio of the core largely fluctuates to result in that the physical properties of yarns as a product are adversely affected, and also the unevenness of hue is produced in the fibers.

FIG. 3 also shows a schematic view of another embodiment of the manufacturing apparatus of the present invention. In FIG. 3, a fused metal in a fusion tank 20 is supplied by a gear pump 21 to a conjugate nozzle 24 through a filter 22. To the nozzle 24 is supplied a molten thermoplastic polymer 25 from an extruder (not shown). In the interior of the nozzle 24, the metal and polymer are combined to form conjugate fibers. The conjugate nozzle 24 has the same structure as shown in FIG. 2. FIG. 4 is an enlarged view of the fused metal path 17 in FIG. 2.

In FIG. 4, packings 27 filled in the fused metal path 17 include for example metals, glasses, inorganic substances and ceramics. The metals include thin lines, sintered filters and sintered particles of metals. The glasses include common glass beads, porous beads, etc. The inorganic substances include zeolite, sand, etc. The ceramics include sintered products of alumina, zirconia, magnesia, silicon carbide, silicon nitride, etc.

When the diameter of the packings is smaller than 0.1 mm, there is a fear that the tip of the nozzle is blocked, which is not preferred. When the diameter exceeds 3.0 mm, filling the packings in the fused metal path 17 becomes difficult. Diameters of 0.1 to 3.0 mm are therefore preferred from the practical viewpoint. The total length of the packings in the fused metal path 17 is preferably about 5 to 20 mm, considering the stability of supply of the fused metal. The rate of spinning is preferably 600 to 2,000 m/min, considering the properties of yarns as a final product.

Figure 5:
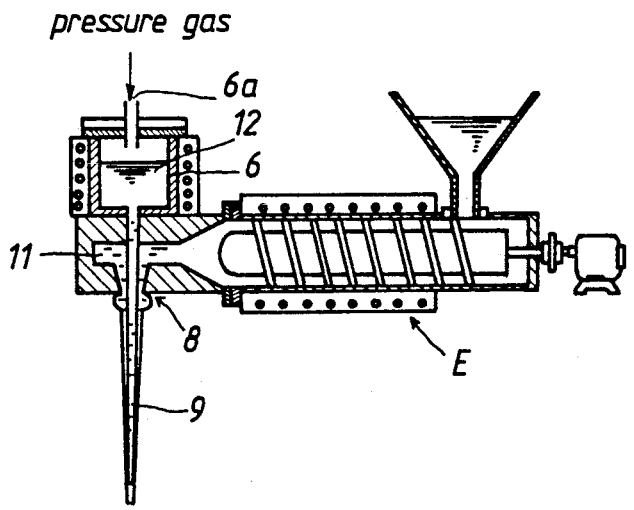
FIG. 5 is a sectional view of the conventional conjugate fiber spinning apparatus.

FIG. 5 is a schematic view of the conventionally used manufacturing apparatus. A fusion tank 6 is provided above the head of an extruder E for thermoplastic polymer, and the tank and head are connected together according to the cross-head form. A numeral 8, is a conjugate spinning nozzle. The upper space of the fusion tank 6 communicates with a pressurized gas inlet tube 6*a*, and the pressurized gas is introduced into the tank 6 through the tube 6*a* to push a fused metal 12 toward the axial portion of the conjugate spinning nozzle 8. A thermoplastic polymer 11 in a molten state is discharged so as to surround the fused metal, and the metal and polymer are pulled out of the tip of the nozzle 8 in the form of sheath-core type conjugate fibers 9. In the method using this type of apparatus, it is very difficult to supply the fused metal uniformly and in a definite amount to the conjugate spinning nozzle 8. It is therefore difficult to obtain conjugate fibers having the core of uniform thickness and no rupture in the longitudinal direction.

Embodiment of the Invention

The present invention will be illustrated with reference to the following examples, but it is not limited to these examples. The characteristics in the examples were measured by the following methods.

(1) Melt viscosity: Melt viscosity at 300° C. measured using Flow Tester CFT-500 (produced by Shimadzu Corp.) under conditions that the load was 50.0 KGF and the die was 1,000 mm in diameter and 10.00 mm in length.

(2) Tenacity and elongation: Measured by means of a tensile tester. Tenacity (g/d) is tenacity at break when the test sample is elongated at a rate of 100%/min. Elongation (%) is elongation at break when the test sample is elongated at a rate of 100%/min.

(3) Sheath-core ratio of core (%): Microscopically observed proportion of the sectional area of the core to that of the conjugate fiber.

(4) Length of discontinuous portion of core: Total length of the discontinuous portions in terms of cm/m obtained by microscopically observing the side of the conjugate fiber.

Figure 6:
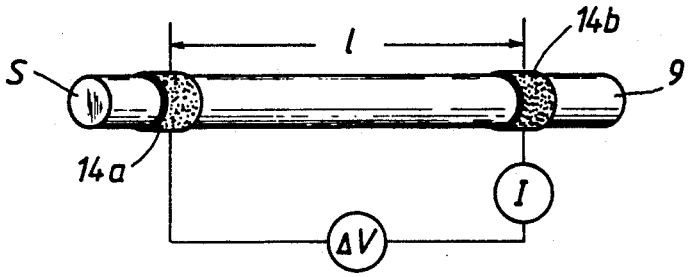
FIG. 6 is a view illustrating the measurement of volume resistivity.

(5) Electric conductivity: Electric conductivity of the sheath-core type conjugate fiber was measured as follows: As shown in FIG. 6, a silver paste was coated around two places on the sheath-core type conjugate fiber 9 with a definite interval therebetween to form two terminals 14*a* and 14*b*, a voltage of 10V is applied between the terminals, and then volume resistivity (Ω·cm) at the time of application of the voltage is calculated from the following equation:

$$\text{Volume resistivity } (\Omega \cdot \text{cm}) = \frac{\Delta V}{I} \cdot \frac{S}{l}$$

wherein l: distance between terminals

ΔV: potential difference

I: current

S: whole sectional area of fiber. Measurement was carried out under the following conditions: l, 5 cm; room temperature, 20° C.; and RH, 65%.

(6) Dyeability: Electrically conductive fibers were sewed into white twill of polyester textured yarn at a pitch of 1 fiber/10 mm, the twill was dyed with a disperse dye under the following conditions, and the degree of dyeability was judged macroscopically.

Dye Dianix Blue AC-E 2% o.w.f.

Condition: 130° C.×60 min.

EXAMPLE 1

Polyethylene terephthalate containing 2% of titanium oxide, its intrinsic viscosity [η] being 0.85 and its melt viscosity being 4000 poises/300° C., was used as a sheath, and a Bi/Sn/In alloy having a melting point of 78.8° C. was used as a core. Using the apparatus shown in FIG. 1, the alloy was fused, supplied under pressure ($N_2$ gas, 0.40 kg/cm$^2$) to the conjugate nozzle shown in FIG. 2 and conjugate-spun together with the polyethylene terephthalate supplied to the nozzle in a molten state at a spinning temperature of 285° C. and a spinning rate of 700 m/min. Thereafter, the resulting conjugate fibers were drawn to 2.5 times the original length on a drawing machine equipped with a pre-heating roll (85° C.) and a heater (150° C.). The resulting conjugate fibers had a denier of 18 d (monofilament), a tenacity of 3.1 g/d and an elongation of 38%. The proportion of the sectional area of the core to that of the conjugate fiber was about 6.8 to about 7.2%. The total length of the discontinuous portions of the core in the longitudinal direction was less than 1 cm/m of the core.

COMPARATIVE EXAMPLE 1

Using such the conventional apparatus as shown in FIG. 5, conjugate spinning and drawing were carried out in the same manner as in Example 1 according to the pressurization form with a pressurized gas inlet tube 6*a*. The resulting sheath-core type conjugate fibers had much unevenness as a property of yarn. The fibers had a denier of 11 to 18 d, a tenacity of 2.4 to 4.8 g/d and an elongation of 31 to 52%.

COMPARATIVE EXAMPLE 2

Spinning was carried out in the same manner as in Example 1 according to a form wherein, in the conventional apparatus, a fusion tank 6 was connected with a conjugate spinning nozzle 8 through a gear pump 4, and a fused metal was supplied by means of the gear pump. However, supply of the fused metal was discontinuous, and the spun fibers broke just below the nozzle to fail to roll up the fibers.

COMPARATIVE EXAMPLE 3

Using the apparatus shown in FIG. 1 wherein the pressure controlling apparatus 13 was not however provided, conjugate spinning and drawing were carried out in the same manner in Example 1 according to the pressurization form wherein the spinning was carried out while maintaining the liquid level in the fusion tank 6 constant under a condition that pressure variation of the inert gas exceeded 0.1 kg/cm$^2$. The resulting sheath-core type conjugate fibers had much unevenness as a property of yarn. The fibers had a denier of 13 to 18 d, a tenacity of 2.5 to 4.2 g/d and an elongation of 32 to 48%.

EXAMPLE 2

Polyethylene terephthalate, its intrinsic viscosity [η] being 0.95 and its melt viscosity being 6,200 poises/300° C., was used as a sheath, and a Bi/Sn alloy having a melting point of 138° C. was used as a core. Using the apparatus shown in FIG. 1, the alloy was fused, supplied under pressure (nitrogen pressure, 0.43 kg/cm$^2$) to the conjugate spinning nozzle 8 and conjugate-spun (spinning temperature, 300° C.; and spinning rate, 700 m/min) together with the polyethylene terephthalate supplied to the nozzle in a molten state. Thereafter, the resulting conjugate fibers were drawn to 1.5 times the original length on a drawing machine equipped with a pre-heating roll (145° C.) and a heater 150° C.). The resulting sheath-core type conjugate fibers had a denier of 16 d (monofilament), a tenacity of 2.6 g/d and an elongation of 25%.

The characteristics (sheath-core ratio of core, volume resistivity and hue) of the conjugate fibers obtained in Examples 1 and 2 and Comparative examples 1 and 3 are shown in Table 1.

TABLE 1

| | Sheath-core ratio of core (%) | Volume resistivity (Ω · cm) | Hue |
|---|---|---|---|
| Example 1 | 7.9 ~ 8.1 | $5 \times 10^3$ | Gray (uniform) |
| Example 2 | 2.0 ~ 2.1 | $1 \times 10^4$ | Metallic (uniform) |
| Comparative example 1 | 0.1 ~ 9.6 | $4 \times 10^3 \sim 8 \times 10^6$ | White ~ gray (non-uniform) |

TABLE 1-continued

| | Sheath-core ratio of core (%) | Volume resistivity (Ω · cm) | Hue |
|---|---|---|---|
| Comparative example 3 | 3.1 ~ 8.0 | $6 \times 10^3 \sim 1 \times 10^4$ | Gray (pale and deep portions are present; nonuniform) |

EXAMPLE 3

Conjugate spinning and drawing were carried out in completely the same manner as in Example 1 except that the manufacturing apparatus shown in FIGS. 3 and 4 were used. In this apparatus, sand particles having a diameter of 0.3 to 0.5 mmϕ were used as a packing.

COMPARATIVE EXAMPLE 4

Conjugate spinning and drawing were carried out in the same manner as in Example 3 except that the conjugate spinning nozzle filled with no packing was used.

EXAMPLE 4

Polyethylene terephthalate, its intrinsic viscosity [η] being 0.95 was used as a sheath, and a Bi/Sn alloy having a melting point of 138° C. was used as a core. Using the apparatus shown in FIGS. 3 and 4 (packing, sintered alumina of 0.3 to 0.4 mmϕ in diameter), the alloy was fused, supplied to the conjugate spinning nozzle and conjugate-spun together with the polyethylene terephthalate supplied to the nozzle in a molten state at a spinning temperature of 300° C. and a spinning rate of 1,000 m/min. The resulting conjugate fibers were drawn to 2 times the original length on a drawing machine equipped with a pre-heating roll (145° C.) and a heater (150° C.).

The physical properties and characteristics of the conjugate fibers obtained in Examples 3 and 4 and Comparative example 4 are shown in Tables 2 and 3.

TABLE 2

| | Denier (d) | Tenacity (g/d) | Elongation (%) | Stability of supply of fused metal* | Total length of packings (mm) |
|---|---|---|---|---|---|
| Example 3 | 18 | 3.1 | 38 | ⊚ | 20 |
| Comparative example 4 | 15 ~ 25 | 2.8 ~ 4.5 | 25 ~ 45 | × | 0 |
| Example 4 | 16 | 2.6 | 25 | ⊚ | 10 |

*At the time of prolonged spinning (72 hours)
⊚ : very good, ×: bad

TABLE 3

| | Sheath-core ratio of core (%) | Volume resistivity (Ω · cm) | Hue |
|---|---|---|---|
| Example 3 | 7.9 ~ 8.1 | $5 \times 10^3$ | Gray (uniform) |
| Comparative example 4 | 0.1 ~ 9.6 | $4 \times 10^3 \sim 1 \times 10^7$ | White ~ gray (nonuniform) |
| Example 4 | 2.0 ~ 2.1 | $1 \times 10^4$ | Metallic (uniform) |

The electrically conductive conjugate fibers of the present invention are characterized in that the sheath-core ratio of the core made of a low-melting metal and the form of the core in the longitudinal direction are sufficiently controlled. As a result, the conjugate fibers have excellent characteristics in terms of not only electric conductivity, but also yarn Properties, hue and dyeability. It is therefore possible to use the electrically conductive conjugate fibers of the present invention in the forms of antistatic working clothes, uniforms, carpets, car sheets, electromagnetic wave shielding materials, etc.

What is claimed is:

1. An electrically conductive and stretched conjugate fiber having a diameter of 50 μm or less and a tenacity of at least 2.6 g/d, comprising a thermoplastic polymer as the sheath and a discontinuous core of low-melting metal, wherein said low melting metal has a melting point equal to or greater than 50° C. and less than the melting point of said thermoplastic polymer characterized in that the sectional area of the core occupies 0.2 to 50% of that of the fiber, the percent variation of the sectional area of the core in the longitudinal direction is 25% or less and the total length of the discontinuous portions of the core in the longitudinal direction is 5 cm or less per meter of the core.

2. An electrically conductive conjugate fiber according to claim 1, wherein the melt viscosity at 300° C. of the thermoplastic polymer forming the sheath is 3,000 to 8,000 poises.

3. An electrically conductive conjugate fiber according to claim 1, wherein the thermoplastic polymer forming the sheath is polyalkylene terephathalate.

4. An electrically conductive conjugate fiber according to claim 1, wherein the core is a low-melting alloy.

5. An electrically conductive conjugate fiber according to claim 1, wherein the total length of the discontinuous portions of the core in the longitudinal direction is 1 cm or less per meter of the core.

6. An electrically conductive conjugate fiber according to claim 1, wherein the fiber is less than about 18 denier.

* * * * *